United States Patent [19]

Furse

[11] Patent Number: 4,616,721

[45] Date of Patent: Oct. 14, 1986

[54] PACKER MILL

[75] Inventor: John H. Furse, Kingwood, Tex.

[73] Assignee: Smith International, Inc., Newport Beach, Calif.

[21] Appl. No.: 675,354

[22] Filed: Nov. 27, 1984

[51] Int. Cl.[4] ..... E21B 17/06

[52] U.S. Cl. ..... 175/320; 285/319; 294/86.18

[58] Field of Search ..... 175/320, 381, 382, 98; 294/86.26, 86.32, 86.33, 86.17, 86.18; 285/319, 18, 4, 3

[56] References Cited

U.S. PATENT DOCUMENTS

| | | | |
|---|---|---|---|
| 2,784,987 | 3/1957 | Corcoran | 285/319 X |
| 2,904,114 | 9/1959 | Webb | 175/315 |
| 2,934,147 | 4/1960 | Baker | 166/63 |
| 3,019,840 | 2/1962 | Kennard | 294/86.24 |
| 3,095,926 | 7/1963 | Rush | 294/86.18 |
| 3,150,718 | 9/1964 | Crowe | 294/86.17 |
| 3,282,358 | 11/1966 | Carothers | 175/411 |
| 4,488,596 | 12/1984 | Akkerman | 294/86.18 X |

FOREIGN PATENT DOCUMENTS

| | | |
|---|---|---|
| WO8302641 | 8/1983 | Work Int. Prop. O. . |
| 834870 | 5/1960 | United Kingdom . |
| 916579 | 1/1963 | United Kingdom . |

*Primary Examiner*—Stephen J. Novosad
*Assistant Examiner*—Thuy M. Bui
*Attorney, Agent, or Firm*—Christie, Parker & Hale

[57] ABSTRACT

A milling tool for removing a packer from a well includes a releasable catcher for supporting remains of a milled packer (51). The catcher has a sleeve (26) with deflectable fingers (29) which normally support the remains of the packer. If the packer should become stuck, the fingers (29) press on a release ring (39) which has a ramp (43) that engages a complementary ramp (42) on a shoulder (41) on the mandrel (14) of the mill. The ramps cam the ring outwardly until the ring breaks in tension at a deliberately weakened location (52). This releases the sleeve (26) to slide downwardly and permit the fingers (29) to deflect inwardly into a recess (23), thereby clearing the bore of the stuck packer.

20 Claims, 5 Drawing Figures

PACKER MILL

BACKGROUND OF THE INVENTION

This invention concerns a mill for removing a packer from an oil well or the like.

A packer is a device placed in the steel casing of an oil well for isolating upper and lower sections of such casing. In a single completion packer there is a central bore and surrounding structure that seals the packer inside the casing. Tubing can be connected to or through the packer for withdrawing fluids from the well. A broad variety of packers are commercially available and the structure thereof is of no significance for this invention.

Some packers are designed for release so that they can be readily removed from the casing and others are more or less permanently fixed in the casing. Even with the readily removable packers it often occurs that corrosion or the like prevents removal. Thus, it is a reasonably common procedure in work-over of oil wells to require milling of the packer to remove it from the well. Such milling destroys the packer and milling chips are pumped out of the well or are caught in downhole debris collectors. Junk that remains in the well can be removed with a magnet or can be milled by a conventional junk mill.

As milling of the packer continues a point is ordinarily reached where the remains of the packer and any tubing or the like hanging from it are freed from the casing and fall free. A grip or catcher on the milling tool used to mill the packer catches these remains so that they can be drawn upwardly and removed from the well bore.

It sometimes occurs as the remains of the packer are lifted that they become stuck in the well bore. It may also occur that the milling tool becomes worn or damaged before the packer is free. In either of these circumstances it may be desirable to remove the milling tool while leaving the remainder of the packer in the well. It is therefore desirable to provide a means for releasing the packer mill from the packer. The mill can then be withdrawn and the well reentered with the same or a different tool for completing removal of the packer.

One approach that has been used to effect such release employs J-slots. A packer mill can be released by lowering and reversing the direction of rotation. Such arrangements are not entirely satisfactory because of the multiplicity of moving parts normally required and the substantial likelihood that such mechanisms may jam. This leaves the operator in the position of fishing the remains of the packer mill as well as the packer, or milling the entire collection of junk in the well. This is obviously costly and time consuming.

Another approach has been to provide pins, screws or stops that shear when a large lifting force is applied to the packer mill. When these parts shear, the means for catching the remains of the packer is released and the packer mill can be withdrawn. This shear type release can have problems since loose parts such as the ends of pins can be produced and require removal from the well. The loose parts themselves may cause jamming. Shear pins and bolts can cause deformation of the holes in which such items are inserted and result in difficulties in reusing the packer mill. Such damage may not be readily repaired in the field, thereby introducing additional delay during work-over.

A potential problem with a release relying on a plurality of shearing elements such as pins, bolts or stops comes from asymmetry in the well or packer being removed. This can result in sequential failure of a series of shearing elements rather than simultaneous failure of such shearing elements, thereby introducing uncertainty in the magnitude of the lifting force that results in release of the packer mill from the remains of the packer, and possible premature release.

It is therefore desirable to provide a means for releasing a packer mill from the remains of a packer with a high degree of reliability and without inherently producing loose parts that may cause further difficulty in the well bore. The release mechanism should not cause damage to the packer mill that prevents prompt reuse of the mill.

SUMMARY OF THE INVENTION

There is, therefore, provided in practice of this invention according to a presently preferred embodiment a packer mill that includes a mandrel for extending through the bore of a packer below the structure that mills the packer. A packer grip sleeve having a plurality of downwardly extending fingers is slidably mounted on the mandrel. The mandrel has an enlarged section adjacent the lower end of the fingers for preventing deflection. A release ring is mounted on the enlarged section of the mandrel engaging the lower end of the sleeve. There are complementary ramps on the ring and the enlarged portion for camming the ring outwardly in response to downward force on the sleeve. This camming tends to enlarge the ring, which preferably has a portion of reduced cross section to promote failure of the ring in hoop tension at a preselected force.

With such an arrangement symmetrical loading is obtained and release can be provided at a predictable pulling force. The ring is ordinarily retained on the mandrel to prevent jamming or other damage in the well. There is no substantial risk of damage to the packer mill and it can be promptly reused merely by replacing the broken ring.

DRAWINGS

These and other features and advantages of the present invention will be readily appreciated by reference to the following detailed description when considered in connection with the accompanying drawings wherein.

DETAILED DESCRIPTION

Figure 1:
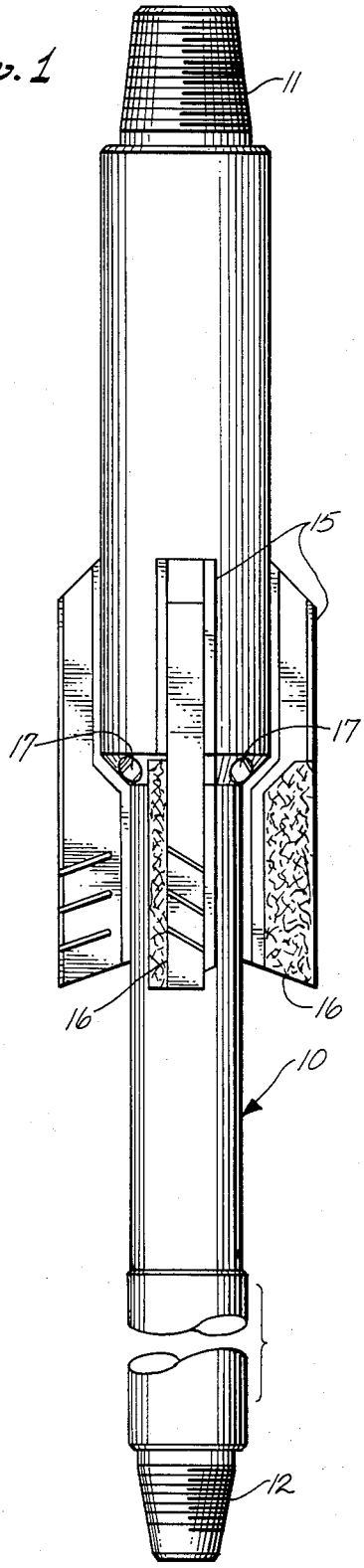
FIG. 1 is a side view of the upper milling portion of a packer mill.
Figure 2:
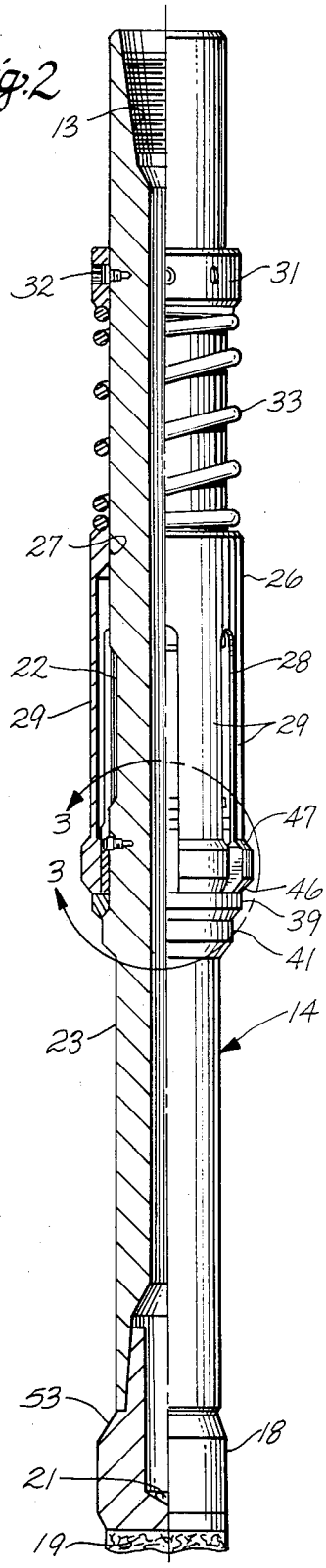
FIG. 2 is a side view, half of which is in longitudinal cross section, of the lower portion of a packer mill constructed according to principles of this invention.

FIGS. 1 and 2 show the upper and lower portions, respectively, of a packer mill. Such a mill is made in two parts for a variety of reasons. The upper milling portion illustrated in FIG. 1 wears during use more than the lower portion and can readily be replaced or set aside for reconstruction as needed. Disassembly of the upper and lower portions eases assembly of the packer catcher on the lower portion illustrated in FIG. 2. Extension subs can be inserted between the upper and lower portions for accommodating different packer lengths. Having the packer mill in two shorter lengths instead of one long piece facilitates handling and shipment.

The upper portion of the packer mill comprises a tubular steel body 10. A threaded pin 11 at the upper end permits connection of the body to a drill string for rotation in a well bore. A similar threaded pin 12 at the lower end permits connection of the upper body to the threaded box 13 of the lower mandrel 14 illustrated in FIG. 2. Four blades 15 are welded on the upper body 10. Each of the blades is faced or dressed in a cutting portion with a conventional hard facing material 16 such as pieces of cemented tungsten carbide in a matrix of brazing alloy. Fluid ports 17 through the upper body between the blades direct drilling fluid from the inside of the body to the region around the blades for removing milling chips and the like.

A conventional end mill 18 is threaded in the lower end of the mandrel 14. The lower face of the end mill is dressed with a hard facing material 19 such as particles of cemented tungsten carbide in a brazing alloy matrix. An exemplary end mill has three lobes and an effective diameter about the same as the diameter of the bore through a packer to be removed. Ports 21 in the end mill discharge drilling fluid through the end face for removing milling chips and other debris from this region.

When the packer mill is used, the end mill acts as a pilot that passes through the bore of the packer. It sometimes occurs that there is junk or other obstruction in the bore of the packer and the end mill cuts away such obstructions so that the mandrel can pass through the bore of the packer and permit the blades on the upper body to engage the packer.

Figure 3:
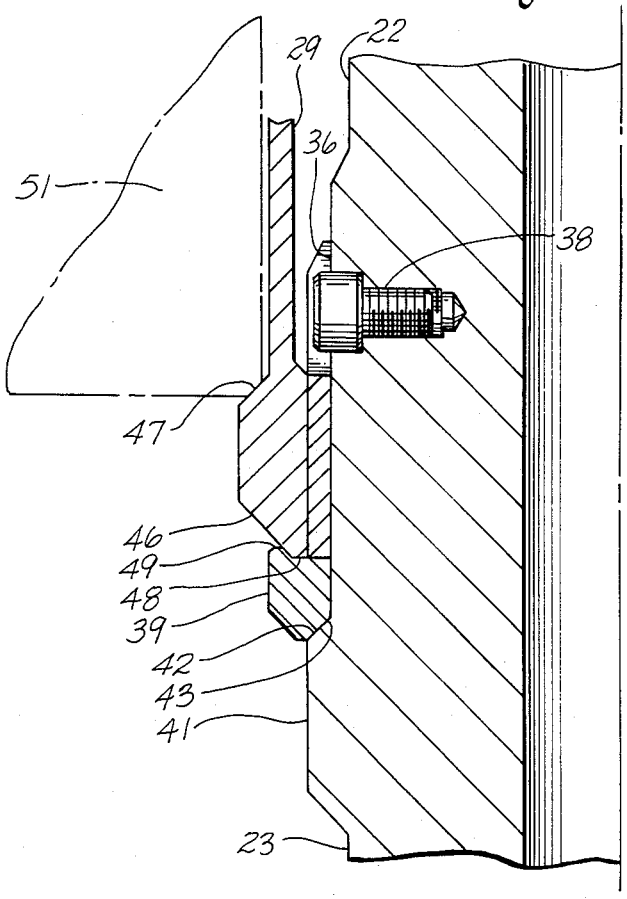
FIG. 3 is an enlarged fragmentary cross section of the release portion of the packer mill.

The lower mandrel has an upper relief portion 22 having a somewhat reduced diameter. There is also a lower relieved portion 23 with a similar diameter. These relieved portions 22 and 23 are separated by an enlargement illustrated in greater detail in the fragmentary cross section of FIG. 3.

A packer grip sleeve or packer retrieving sleeve 26 is mounted on the mandrel. The upper end 27 of the sleeve fits on the mandrel so that it can slide longitudinally on the mandrel. Below the upper end, longitudinal slots 28 are cut in the sleeve to define six longitudinally extending fingers 29 which, as described in greater detail hereinafter, can elastically deflect inwardly during use of the packer mill.

A shoulder ring 31 is secured in a fixed longitudinal position near the upper end of the mandrel by a plurality of socket head cap screws 32. A coil spring 33 fits between the shoulder ring 31 and the upper end of the grip sleeve 26 for biasing the grip sleeve downwardly.

The enlargement on the mandrel has a cylindrical annular surface 36 and a slotted annular spacer 37 is fastened on the cylindrical surface by a plurality of socket head cap screws 38. A release ring 39 is located between the spacer 37 and an enlarged shoulder 41 on the mandrel. The upper face of the shoulder 41 has a tapered or conical ramp 42. There is a complementary female ramp surface 43 in the release ring 39. Both ramps extend at a 45° angle, which is the angle of maximum shear stress with axial force loading between the sleeve and mandrel.

The lower ends of the fingers 29 are enlarged. The enlarged end has a conical entry taper 46 at its lower end. There is an upper packer engaging taper 47 at the upper end of the enlargement. A blunt bottom 48 on the enlarged end of the finger rests against the upper face of the release ring 39. The release ring also includes a raised rim 49 that fits a short distance around the lowermost ends of the fingers to inhibit outward deflection of the fingers. The inner side of the enlarged ends of the fingers are adjacent the slotted spacer 37. The spacer prevents inward deflection of the fingers when the sleeve is in the longitudinal position shown in FIGS. 2 and 3. The spacer is removable for assembly of the release ring on the mandrel. The spacer also avoids damage to the mandrel by the fingers and can be replaced if damaged.

When the packer mill is used, the mandrel portion is lowered through the bore of a packer with the end mill 18 removing any obstructions in that bore. The outside diameter of the enlarged ends of the fingers is larger than the inside diameter of the packer to be removed. Thus, the entry taper 46 engages the upper end (not shown) of a packer as the mill passes through the bore. This presses the grip sleeve 26 upwardly and compresses the spring 33. When the ends of the fingers pass beyond the slotted spacer 37 they are cammed inwardly by the entry taper engaging the packer and deflect into the upper recessed region 22 on the mandrel. This inward deflection of the fingers permits them to pass through the bore of the packer.

When the fingers have passed through the bore they spring back to their original position, and the spring 33 presses the grip sleeve back into engagement with the release ring.

As milling of the packer proceeds, a remainder of the packer typically breaks loose from the casing and drops in the well bore until caught by the enlarged ends of the fingers. This occurs as illustrated in the fragmentary cross section of FIG. 3 where the lower end 51 of the remnants of a packer is shown resting against the packer engaging taper 47 on the fingers. Since the fingers cannot move inwardly because of the annular spacer 37, they support the packer which can thus be lifted from the well bore.

In the event the remains of the packer being lifted from the well become stuck in the bore, an increasing lifting force is applied on the mandrel. The resultant downward force of the lower end of the packer 51 on the fingers presses the blunt lower end 48 of the fingers against the release ring. The complementary ramps 42 and 43 on the shoulder 41 and ring 39, respectively, cause a substantial hoop tension on the release ring.

Figure 4:
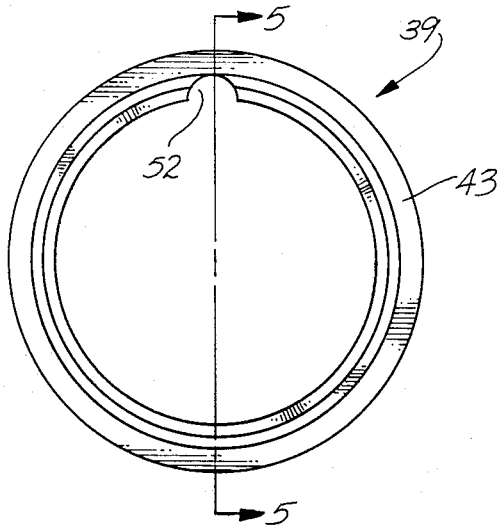
FIG. 4 is an end view of an exemplary ring employed in practice of this invention.
Figure 5:
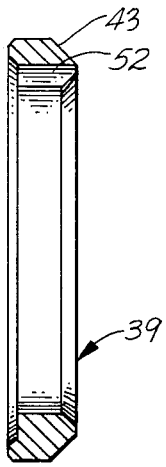
FIG. 5 is a transverse cross section of the ring of FIG. 4.

The release ring is also illustrated in FIGS. 4 and 5. As can be seen in these drawings a roughly semi-circular slot 52 is cut in the inside of the ring so that the wall thickness of the ring is reduced in one region, thereby providing a deliberately weakened section in the ring having a predetermined rupture strength.

When the lifting force reaches a selected magnitude the hoop tension in the ring exceeds the rupture strength of the remaining wall of the ring adjacent the slot 52. The resultant breakage of the ring in tension permits it to further enlarge and readily pass over the shoulder 41 and drop to the lower end of the mandrel. A taper 53 on the top of the end mill 18 retains the broken release ring and keeps it concentric with the mandrel.

As the mandrel continues to move upwardly, the grip sleeve remains temporarily fixed in the bore or falls past the shoulder 41 to be picked up again by the mandrel. The remnants of the packer acting against the packer engaging taper 47 on the enlarged ends of the fingers deflect the fingers inwardly into the lower recessed region 23 on the mandrel. This permits the fingers to clear the bore of the packer and be drawn upwardly through the packer, leaving the remnants of the packer in the well bore.

By having the ring break in a single place adjacent the slot, good reproducibility of the selected force to break the ring can readily be obtained. Further, the ring remains intact except for that single break and is retained concentrically on the mandrel so as not to introduce additional junk in the well bore. However, if the broken ring should catch on the stuck remnants of the packer, the taper 53 on the end mill further stretches the broken ring so that it can fall free and permit withdrawal of the packer mill.

It will be apparent to one skilled in the art that many modifications and variations can be made in a packer mill constructed according to principles of this invention. For example, instead of cutting an internal slot for reducing the wall thickness of the release ring, one could instead grind a flat or the like on the outside of the release ring. The use of an inside slot is advantageous since friction forces adjacent the ramp have minimal influence on rupture of the release ring. Further, if one should desire to reduce the force needed to release the packer mill it is a simple matter to further reduce the cross section of the ring by grinding or filing the outside of the ring opposite the slot. Thus, a change can be made readily in the field.

In the illustrated embodiment the ring and mandrel each have 45° ramps for camming the ring. If desired one of these surfaces could be rounded to ride on the other conical surface. The complementary ramps are preferred for minimizing pressure at the interface and consequent wear. Also, the shoulder ring 31 could be deleted by having the upper end of the spring engage a shoulder on the upper body or on a sub between the upper and lower parts of the packer mill.

It will also be apparent that a mandrel having a release feature as described can be used with other end mills and upper body sections for releasing the packer from the well bore. For example, the upper body can include a washover shoe for milling only an outer portion of the stuck packer. Many other modificiations and variations will be apparent to one skilled in the art and the spope of this invention is to be determined by reference to the following claims.

What is claimed is:

1. A packer mill comprising:

catcher means for passing through the bore of a packer and catching remains of a milled packer; and release means for releasing the remains of a packer upon application of a selected lifting force by failing in tension at a single location and formed to remain in a single piece and be retained on the packer mill after failing in tension.

2. A packer mill comprising:

catcher means for passing through the bore of a packer and catching remains of a milled packer; and a ring having a reduced cross section portion and means for appying hoop tension to the ring for releasing the remains of a packer upon application of a selected lifting force by failing in tension at the reduced cross section portion.

3. A packer mill as recited in claim 2 wherein the means for applying hoop tension comprises:

a ramp on the packer mill; and a complementary ramp on the ring for camming the ring toward enlargement upon application of a lifting force.

4. A packer mill as recited in claim 2 wherein the reduced cross section portion comprises a slot inside the ring.

5. A packer mill comprising an elongated mandrel for extending through the bore of a packer to be milled and a releasable catcher on the mandrel for catching remains of a milled packer, the catcher comprising:

an enlarged central portion on the mandrel;

a sleeve slidably mounted on the mandrel;

a plurality of longitudinally extending elastic fingers on the sleeve, the ends of the fingers being adjacent the enlarged portion when the sleeve is in a central position;

means for biasing the sleeve downwardly toward the central position;

a release ring on the mandrel for inhibiting the sleeve from sliding downwardly beyond the central position;

means for bursting the ring in hoop tension upon application of sufficient downward force on the sleeve for permitting the sleeve to slide beyond the central position.

6. A packer mill as recited in claim 5 wherein the ring has a reduced cross section portion for failing in tension at a selected hoop stress.

7. A packer mill as recited in claim 5 wherein the means for bursting the ring comprises a ramp on the mandrel and a complementary ramp on the ring for camming the ring outwardly in response to an axial force on the sleeve.

8. A packer mill as recited in claim 5 wherein the fingers extend downwardly and the lower ends of the fingers engage the ring.

9. A packer mill as recited in claim 5 comprising a first reduced diameter portion on the mandrel above the enlarged central portion and a second reduced diameter portion on the mandrel below the enlarged central portion so that the fingers can deflect inwardly when the sleeve is above or below the central position.

10. A packer mill comprising:

a lower mandrel for extending through the bore of a packer;

an upper milling body for milling a packer;

a packer grip sleeve slidably mounted on the mandrel, the sleeve including a plurality of longitudinally extending fingers;

an enlarged section on the mandrel adjacent the lower end of the sleeve;

a release ring on the enlarged section of the mandrel engaging the lower end of the sleeve; and complementary ramps on the ring and enlarged section for camming the ring outwardly in response to downward force on the sleeve.

11. A packer mill as recited in claim 10 wherein the ring includes a reduced cross section portion for failing at a selected hoop stress.

12. A packer mill as recited in claim 10 wherein the ring includes a slot inside the ring so that a portion of the ring adjacent the slot has a lesser rupture strength than the balance of the ring.

13. A packer mill comprising:

an upper milling body for milling a packer;

a lower mandrel for extending through the bore of a packer being milled;

a catcher sleeve slidably mounted on the mandrel for catching remains of a milled packer;

a plurality of downwardly extending elastic fingers on the sleeve having an outwardly extending portion at the lower end for engaging a lower end of such a packer adjacent its bore;

an enlarged annular surface on the mandrel adjacent the lower ends of the fingers for preventing inward deflection of the fingers;

a release ring on the mandrel engaging the lower ends of the fingers and including a tapered ramp surface;

an enlarged tapered ramp on the mandrel complementary to the ramp on the ring for camming the ring outwardly in response to downward force on the sleeve, the enlarged ramp having a sufficient diameter for stretching the ring beyond its hoop strength; and a reduced diameter portion on the mandrel below the enlarged ramp for permitting inward deflection of the fingers when the ring has ruptured and the ends of the fingers have travelled below the enlarged ramp on the mandrel.

14. A packer mill as recited in claim 13 further comprising:

a spring for biasing the sleeve downwardly toward engagement with the release ring;

a second reduced diameter portion on the mandrel above the enlarged annular surface for permitting inward deflection of the fingers when the ends of the fingers have travelled above the annular surface in response to engagement with an upper portion of a packer.

15. A packer mill as recited in claim 14 further comprising a spacer sleeve between the annular surface on the mandrel and the lower ends of the fingers.

16. A packer mill as recited in claim 14 wherein the outwardly extending portion on the lower ends of the fingers comprises a downwardly facing entry taper for engaging an upper portion of a packer for sliding the sleeve upwardly on the mandrel and deflecting the fingers inwardly for passing through the bore of a packer.

17. A packer mill as recited in claim 16 wherein the outwardly extending portion on the lower ends of the fingers comprises an upwardly facing taper for engaging a lower portion of a packer for lifting remains of a packer from a well bore.

18. A packer mill as recited in claim 13 wherein the enlarged ramp on the mandrel comprises an upwardly facing 45° male conical surface; and the ramp surface on the ring comprises a downwardly facing 45° female conical surface.

19. A packer mill as recited in claim 13 wherein the release ring comprises a reduced cross section portion having a hoop strength less than the hoop strength of the balance of the ring for selective rupture of the ring at the reduced cross section portion.

20. A packer mill as recited in claim 19 wherein the reduced cross section portion comprises a slot inside the ring.

* * * * *